United States Patent [19]

Bryan

[11] Patent Number: 4,489,885

[45] Date of Patent: Dec. 25, 1984

[54] RAIL FASTENING SYSTEM

[75] Inventor: James S. Bryan, Haywood County, N.C.

[73] Assignee: Dayco Corporation, Dayton, Ohio

[21] Appl. No.: 404,101

[22] Filed: Aug. 2, 1982

[51] Int. Cl.[3] ..... E01B 9/30; E01B 9/62; E01B 9/68

[52] U.S. Cl. ..... 238/349; 238/107; 238/351

[58] Field of Search ..... 238/107, 299, 304, 310, 238/321, 349, 351, 353

[56] References Cited

U.S. PATENT DOCUMENTS

| | | | |
|---|---|---|---|
| 1,863,145 | 6/1932 | Young | 238/304 X |
| 2,205,584 | 6/1940 | Warr | 238/349 X |
| 3,314,605 | 4/1967 | Waters | 238/321 |
| 3,515,347 | 6/1970 | Waters et al. | 238/310 |
| 3,658,247 | 4/1972 | Serafin et al. | 238/349 |
| 4,109,860 | 8/1978 | Serafin et al. | 238/351 X |
| 4,111,361 | 9/1978 | Sonneville | 238/107 X |
| 4,175,700 | 6/1977 | Gehrke | 238/299 |
| 4,312,477 | 1/1982 | Hinson | 238/304 |
| 4,378,910 | 4/1983 | Sonneville | 238/349 |

OTHER PUBLICATIONS

BTREC Advt.—BTREC Inc.

*Primary Examiner*—Howard Beltran
*Attorney, Agent, or Firm*—Joseph V. Tassone

[57] ABSTRACT

A system for fastening a rail to a foundation such as railroad ties or sleepers to form a railroad track. The system includes L-shaped inserts which are imbedded into the foundation and extending above it, supports which are laterally located with respect to the rails, and a fastening member or clip securing the rails. The main portion of each clip is mounted between the insert and the foundation, and one end contacts the upper surface of the supports. The other end of the clip contacts the flange of the rail, and has an offset lower surface which applies vertical and lateral pressure to the edge of the flange. The clip is made of a metal material and is a resilient spring having a multiple curved cross-section in order to apply compressive forces to the rail flange, the curved portions having undulating portions which make the various contacts.

16 Claims, 2 Drawing Figures

RAIL FASTENING SYSTEM

BACKGROUND OF THE INVENTION

1. Field of the Invention

This invention relates to a system for fastening a rail to a foundation to form a railroad track, and primarily to a fastening member in the form of a clip for securing the rail against extreme movements. This is important in maintaining the correct gage of the track despite variations in load on the rail. While there are many types of fastening systems utilizing clips for securing the rails, the present invention is of the type wherein one end of the clip is resiliently forced against the lower flange of the rail, and the other end rests upon a support which is spaced laterally of the rail. Intermediate of the rail and support is located an insert which is cast into and embedded in the foundation, which may be a tie or a sleeper; the insert extends above the surface of the foundation and is L-shaped so that crossbar of the insert is spaced above the foundation. The main body of the clip is placed under the crossbar so that the upper surface of the clip is held by the crossbar and permits the lower surface of the ends of the clip to maintain contact with the rail flange and the support.

2. Prior Art Statement

Fastening systems of the type generally described above are known and disclosed in the following publications:

Waters' U.S. Pat. No. 3,314,605 utilizes a clip made of a straight flat plate of spring steel. When the clip is installed and under stress as in FIG. 2, the clip is bowed slightly upwardly between the support 4 and the insert 5, and is bowed slightly downwardly between the insert and the flange-contacting end. An insulator 6 is placed over the flange and the end of the clip actually contacts the insulator, rather than the flange itself.

Water et al U.S. Pat. No. 3,515,347 has a similar arrangement to the earlier Waters' patent, but the insulator on the flange is specially shaped to receive the bifurcated ends of the clip. In addition, the support has a specially shaped depression to receive the other end of the clip.

Serafin et al utilizes a U-shaped steel clip which has outwardly extending legs that bear against an insulator on the rail flange to secure the rail in place. The other end of the clip forming the bight of the clip contacts the support member.

Gehrke is primarily directed to a pad placed under a rail, but also discloses a metal leaf spring which acts to secure the rail. It has a configuration generally similar to the clips of the Waters' patents.

Hixson also discloses a flat clip similar to Waters', also made of metal, and shaped so that the ends resting on the support fit within recesses on the support.

A BTREC advertisement of BTREC Inc. (date unknown) illustrates a clip which is similar to Waters', and is believed to be related to Waters'.

SUMMARY OF THE INVENTION

The present invention provides an improved fastening system wherein the principal feature resides in the use of a novel fastening member or clip for securing the rail. The clip is made of a resilient metal material and is essentially in the form of an undulating multiple curved plate which acts in spring-like fashion. The rail retaining end and opposite end each have surfaces which contact the upper surfaces of the rail flange and the support which is remote from the rail, while another undulating surface fits under the insert which is cast into the foundation. The end contacting the rail is thickest in cross-section, and the remainder of the clip has a gradually decreasing cross-sectional thickness until reaching a minimum at the support-contacting end.

By devising the clip as described, it is simple to manufacture, is very easy to install or remove, and has superior retaining properties with respect to the rail. The rail-retaining end applies a constant spring tension in a downward direction at the edge of the flange, and is also provided with an offset configuration which simultaneously applies lateral pressure against the side of the flange. Thus, no intervening insulator or other type of adaptor is required to create these pressure points.

The opposite end of the clip is in direct contact with the support, unlike the conventional construction which utilizes a bearing member between the clip and support. The undulating portion of the clip which fits under the insert, contains a groove shaped to promote a contiguous fit with the insert, or a bearing member which is placed between the insert and the groove.

Other objects, uses and advantages of the invention are apparent from the following description and accompany drawings, which set forth the preferred embodiment of the invention.

DESCRIPTION OF THE PREFERRED EMBODIMENT

Figure 1:
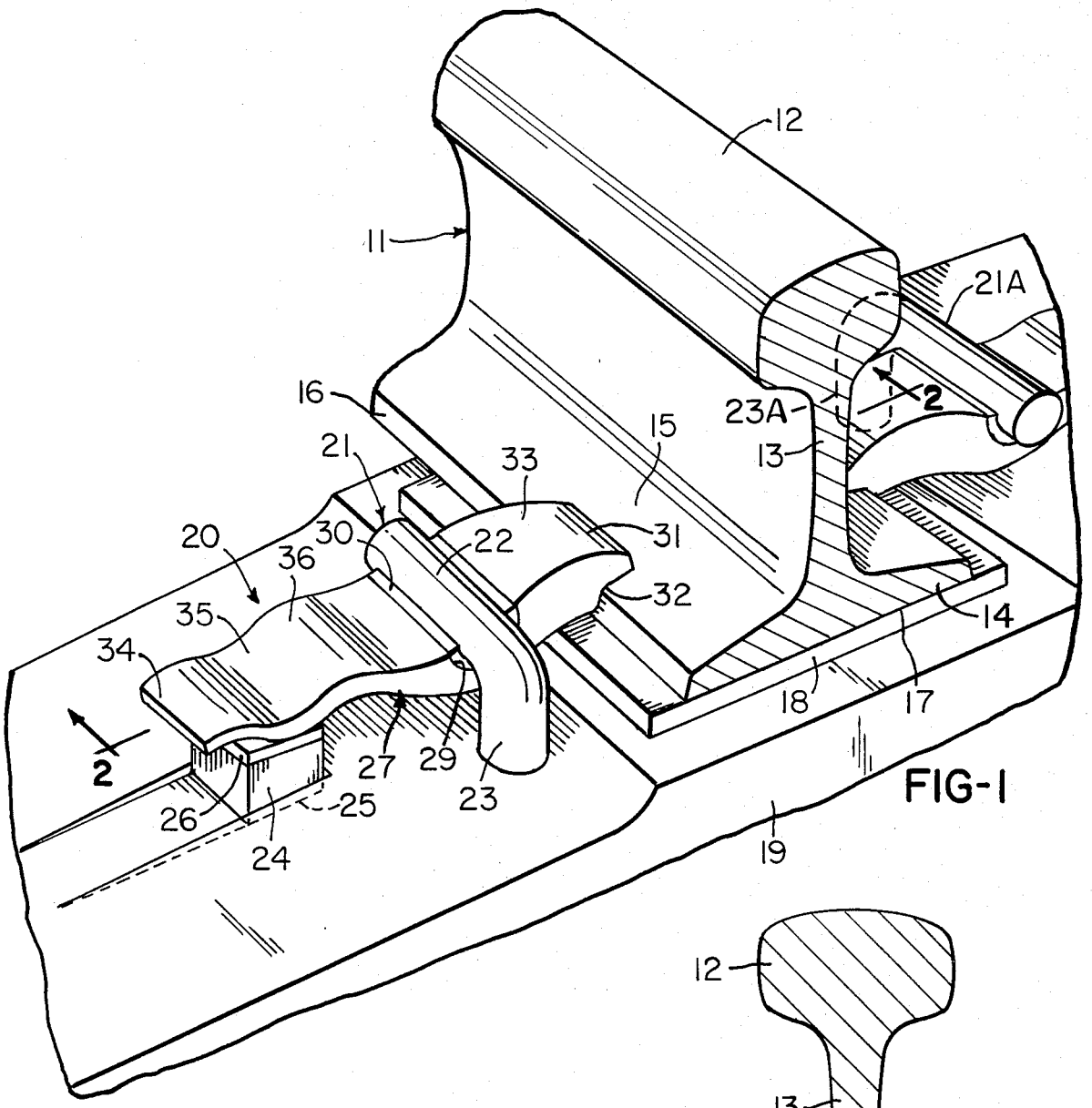
FIG. 1 is a perspective view of the novel fastening system, with the fastening member in its installed position.

A typical railroad track system is known to consist of a pair of rails held in spaced parallel relationship, resting on a series of lateral ties or sleepers, usually made of concrete, and generally referred to as foundations. The drawings illustrate only sufficient portions of the system necessary to bring out the salient features of the invention.

As shown in the drawings, a typical rail 11 has the principal wheel-contacting surface 12, a vertical rib 13, and lower flanges 14 extending laterally at each side of the rib. Each flange has an upper surface 15 which slopes downwardly from the rib to an outer edge 16. The lower surface 17 of the rail rests upon a resilient tie pad 18 which is placed upon the tie 19 and acts as a cushion for the rail.

The rail fastening system is generally designated by reference number 20, and includes an insert 21 which is L-shaped and is formed of a crossbar 22 extending parallel to the track, and a vertical leg 23 which is cast into the foundation. The insert is located a short distance laterally from the rail. The system further includes a support 24 which is in the shape of a generally rectangular cross-section block of steel or concrete, located outwardly of the insert 21. The support is mounted within a groove 25 to secure it from lateral movement. The support has an upper surface which tapers laterally downward toward the rail, and has an insulating bearing 26 mounted on the upper surface which provides good electrical insulation. The bearing is made of a friction-resistant plastic material such as phenolic, nylon or glass fiber reinforced resin. The principal member of the fastening system is a clip 27, which is in the form of a spring-like metal member having a multiple-curved cross-section in which the curved members undulate. The material of which the clip is made is preferably a high quality spring steel.

The clip 27 is designed to fit under the insert 21, and has a downwardly extending undulating lower surface 28 which is below the insert, and a groove 29 in the upper surface. An insulating bearing 30, also providing a good electrical insulation, is made of the same material as bearing 26, shaped to fit within the groove to receive the crossbar 22 of the insert. The clip is capable of insertion under the insert because the insert has been originally cast into the foundation just far enough to allow the crossbar to assume the position shown. One end 31 of the clip is designed to contact the rail flange directly, without the need for intervening insulators or adaptors. The end 31 has an offset portion creating an internal shoulder 32 on the lower surface, with the shoulder retaining the edge 16 and tapered surface 15 of the flange to prevent displacement of the rail relative to the foundation. The upper surface of the end 31 has an undulating segment 33 which provides a downwardly compressive force to assist in retaining the flange. The opposite end 34 of the clip has a further downwardly undulating cross-section 35, the lower surface of which bears against the bearing 26 of the support 24. This section 35, coupled with a further undulating section 36, provides a spring-like action which provides downward compression of the end 34 against the support 24. The overall thickness of the clip varies from a maximum at end 31, decreasing generally constantly to a minimum at the other end 34. This creates the desirable spring effect needed for retaining the rail flange, and the rail, in place.

The installation of the clip 27 may be accomplished by several methods. For example, the clip may first be placed under the insert 21 so that the shoulder 32 bears against the edge 16 and surface 15 of the flange. Next, the opposite end 34 is lifted and the support 24 is placed in position under that end. Finally, the end 34 is released to bear against the bearing 26 on the support.

Another method of installation might consist of the same first step, namely placing the clip under the insert 21 to permit shoulder 32 to bear against the flange of the rail. However, instead of lifting the end 34, the support 24 may simply be driven into position under the end 34.

Figure 2:
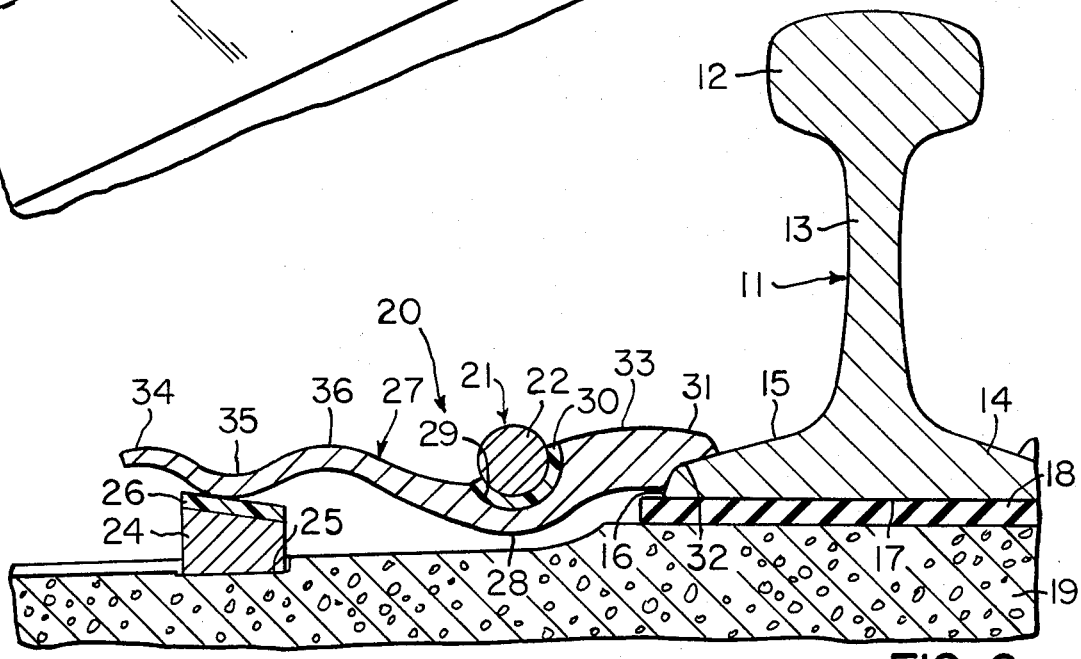
FIG. 2 is a sectional view taken view taken along the lines 2—2 of FIG. 1.

The above description refers to installation of a single clip, insert and support system as best shown in FIG. 2. However, it is normal to apply an opposite identical clip 27 and insert 21A as shown in FIG. 1, to be used with an identical bearing (not shown). Preferably, the insert 21A is mounted in an opposite but parallel direction to insert 21; that is, the insert 21A is rotated 180 degrees so that the leg 23A is at the other end of the insert. This is shown in FIG. 1.

Other modifications are contemplated; for example, the bearings 26 and 30 may be omitted, and the shape of internal shoulder 32 may be varied to fit a specific configuration in the edge of the rail flange. The specific configuration of the clip and its relationship to the other components of the fastening system may also be modified within the scope of the inventions and the appended claims.

I claim:

1. In a system for fastening a rail to a foundation, said rail having a rail flange provided with an upper surface and an outer edge depending from said upper surface, said system comprising a support located laterally of said rail and mounted on said foundation, said support having an upper surface, an insert located between said rail and said support and embedded in and extending above said foundation, and a fastening member having opposed ends and securing said rail in place by being mounted under and disposed against said insert intermediate said ends thereof, one of said ends of said fastening member contacting said rail flange and the other of said ends contacting said upper surface of said support; the improvement wherein said fastening member comprises a one-piece resilient spring member having said one end thereof directly contacting a portion of said upper surface of said rail flange and a portion of said outer edge of said rail flange and having a multiple curved cross-section to apply lateral and vertical compressive forces to said rail flange.

2. The system of claim 1 wherein said fastening member is made of a metal material.

3. The system of claim 2 wherein said metal material is a high quality spring steel.

4. The system of claim 1 wherein said fastening member is thicker in cross-section at its said one end than at its said other end.

5. The system of claim 4 wherein said fastening member has a generally constantly decreasing cross-sectioned thickness from said one end thereof to said other end thereof.

6. The system of claim 1 wherein said fastening member has a plurality of undulating portions throughout its length.

7. The system of claim 6 wherein said one end that contacts said rail flange has an upwardly undulating portion.

8. The system of claim 6 wherein a first downwardly undulating portion contacts said support, a second downwardly undulating portion is located under and receives said insert, a first upwardly undulating portion contacts and secures said rail flange, and a second upwardly undulating portion is located intermediate of said downwardly undulating portions.

9. The system of claim 6 wherein said other end that contacts said support has a downwardly undulating portion.

10. The system of claim 9 further comprising a bearing member mounted on said support and defining said upper surface of said support, said downwardly undulating portion having a lower surface contacting said bearing member.

11. The system of claim 6 wherein an intermediate undulating portion is located between said other end and said insert.

12. The system of claim 11 wherein said intermediate undulating portion is upwardly undulating.

13. The system of claim 6 wherein said fastening member has a downwardly undulating portion under said insert.

14. The system of claim 13 wherein said downwardly undulating portion has an upper surface under said insert and has a groove located therein.

15. The system of claim 14 comprising a bearing member mounted within said groove.

16. The system of claim 15 wherein said insert comprises a horizontal member received by and contiguous with said bearing member.

* * * * *